United States Patent [19]

Johnson, Jr.

[11] Patent Number: 4,999,001

[45] Date of Patent: Mar. 12, 1991

[54] BINGO GAME APPARATUS

[76] Inventor: Robert G. Johnson, Jr., 507 Dunlop Dr., Opelika, Ala. 36801

[21] Appl. No.: 519,806

[22] Filed: May 7, 1990

[51] Int. Cl.[5] ..... A63F 3/06

[52] U.S. Cl. ..... 273/269; 273/144 A

[58] Field of Search ..... 273/268, 269, 144 R, 273/144 A, 145 R, 145 A

[56] References Cited

U.S. PATENT DOCUMENTS

| | | | |
|---|---|---|---|
| 689,870 | 12/1901 | Graham | 273/269 |
| 1,061,999 | 5/1913 | Grondahl | 273/269 |
| 2,003,979 | 6/1935 | Skoric | 273/144 A |
| 2,669,456 | 2/1954 | Hickey | 273/144 A |

FOREIGN PATENT DOCUMENTS

| | | | |
|---|---|---|---|
| 1218055 | 1/1971 | United Kingdom | 273/144 A |

*Primary Examiner*—Edward M. Coven
*Assistant Examiner*—William M. Pierce
*Attorney, Agent, or Firm*—Leon G. Gilden

[57] ABSTRACT

An apparatus including a playing board defined by a generally circular configuration, including a planar top surface with four equally spaced recessed triangulated player sections, wherein each player section includes a predetermined number of numbered recesses therewithin to correspond with four different colored sets of correspondingly numbered spheres. The spheres are positionable within a rotating tumbler and are permitted to be removed from the tumbler in a one-at-a-time sequence for selective association with one of said recesses. A further series of white spheres and a further series of black spheres are provided to direct respectively a free turn for the player and "wild" spheres for the black spheres for use with any number or coloration. Each player must utilize a corresponding coloration for a corresponding player position. Additionally, a plurality of dice are utilized to direct play in sequence about the board game. The tumbler apparatus utilized permits the balls to be directed from the tumbler through an opening that upon being positioned in a downward orientation permits a single sphere to be removed. A player to associate a sequence of spheres in a sequential array in association with a BINGO arrangement is declared a winner.

4 Claims, 4 Drawing Sheets

PRIOR ART

BINGO GAME APPARATUS

BACKGROUND OF THE INVENTION

1, Field of the Invention

The field of invention relates to bingo games, and more particularly pertains to a new and improved bingo game apparatus wherein the same utilizes variously colored spheres in association with various player positions to be received from a drum to effect a sequential array of numbered spheres within a game board.

2, Description of the Prior Art

Bingo game apparatus of various types have been utilized in the prior art. Bingo games are established for purposes of amusement and entertainment, as well as providing concentration in association of a randomly selected token representative of a bingo game positioning marker. Examples of prior art structure may be found in U.S. Pat. No. 4,226,420 to Corday wherein a bingo game is provided for blind individuals, wherein tactile materials are provided for numbers of a bingo card, with the surface of the numbers having a hooked nap for association of the numbers by such individuals.

U.S. Pat. No. 4,218,063 to Cooper, et al. sets forth an electronic bingo game apparatus utilizing a transmitter and at least one receiver to associate signals from the transmitter to the receiver associating various bingo numbers selected.

U.S. Pat. No. 4,323,240 to Stewart, et al. sets forth a bowling game wherein various bowling spheres are withdrawn from an interior portion of a housing for association with a score card.

U.S. Pat. No. 4,274,638 to Julien sets forth a game switch wherein a matrix of conductive flexible strips are utilized, wherein a ball is depressed at an intersection of such strips to effect contact for registration of a predetermined number in association with a bingo game apparatus.

As such, it may be appreciated that there continues to be a need for a new and improved bingo game apparatus wherein the same addresses both the problems of ease of use, as well as effectiveness in construction and in this respect, the instant invention substantially fulfills this need.

SUMMARY OF THE INVENTION

In view of the foregoing disadvantages inherent in the known types of bingo game structures now present in the prior art, the present invention provides a bingo game apparatus wherein the same utilizes a combination of a tumbler and dice arrangement to direct sequential turns of a bingo game in use. As such, the general purpose of the present invention, which will be described subsequently in greater detail, is to provide a new and improved bingo game apparatus which has all the advantages of the prior art bingo game structure and none of the disadvantages.

To attain this, the present invention provides an apparatus including a playing board defined by a generally circular configuration, including a planar top surface with four equally spaced recessed triangulated player sections, wherein each player section includes a predetermined number of numbered recesses therewithin to correspond with four different colored sets of correspondingly numbered spheres. The spheres are positionable within a rotating tumbler and are permitted to be removed from the tumbler in a one-at-a-time sequence for selective assocation with one of said recesses. A further series of white spheres and a further series of black spheres are provided to direct respectively a free turn for the player and "wild" spheres for the black spheres for use with any number or coloration. Each player must utilize a corresponding coloration for a corresponding player position. Additionally, a plurality of dice are utilized to direct play in sequence about the board game. The tumbler apparatus utilized permits the balls to be directed from the tumbler through an opening that upon being positioned in a downward orientation permits a single sphere to be removed. A player to associate a squence of spheres in a sequential array in association with a BINGO arrangement is declared a winner.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bingo game apparatus which has all the advantages of the prior art bingo game structure and none of the disadvantages.

It is another object of the present invention to provide a new and improved bingo game apparatus which may be easily and efficiently manufactured and marketed.

It is a further object of the present invention to provide a new and improved bingo game apparatus which is of a durable and reliable construction.

An even further object of the present invention is to provide a new and improved bingo game apparatus which is susceptible of a low cost of manufacture with regard to both materials and labor, and which accordingly is then susceptible of low prices of sale to the consuming public, thereby making such bingo game apparatus economically available to the buying public.

Still yet another object of the present invention is to provide a new and improved bingo game apparatus which provides in the apparatuses and methods of the prior art some of the advantages thereof, while simultaneously overcoming some of the disadvantages normally associated therewith.

Still another object of the present invention is to provide a new and improved bingo game apparatus wherein the same utilizes a combination of randomly directed dice and randomly selected spheres to direct individual players to attempt to develop a sequence of spheres within a preselected position upon a game board.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
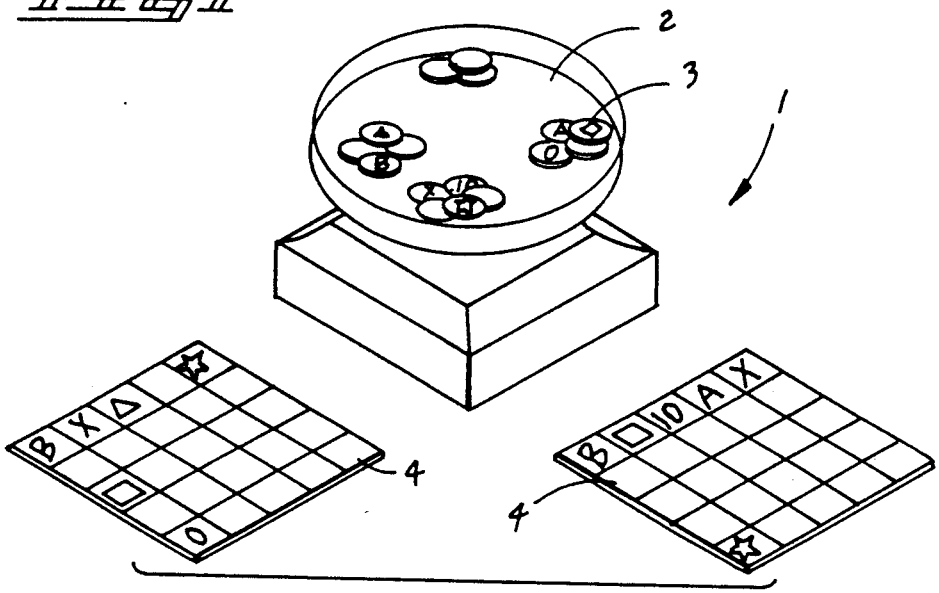
FIG. 1 is an isometric illustration of a prior art bingo game apparatus.

With reference now to the drawings, and in particular to FIGS. 1 to 7 thereof, a new and improved bingo game apparatus embodying the principles and concepts of the present invention and generally designated by the reference numeral 10 will be described.

Figure 2:
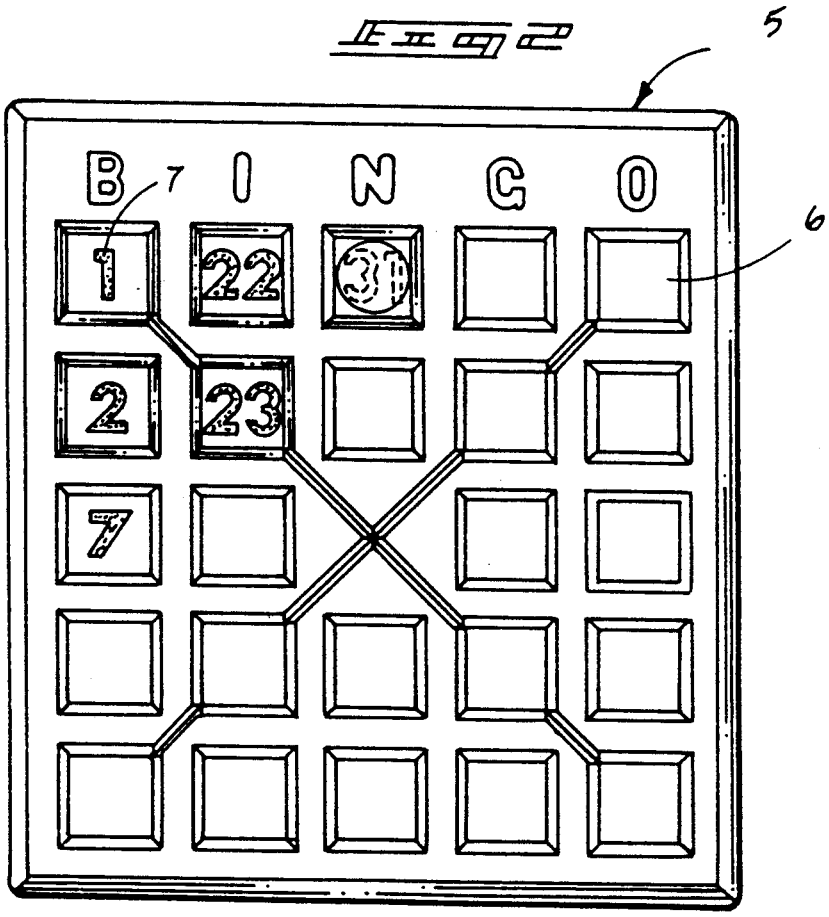
PRIOR ART Fig 2
FIG. 2 is an orthographic top view of a further prior art bingo game apparatus.
Figure 3:
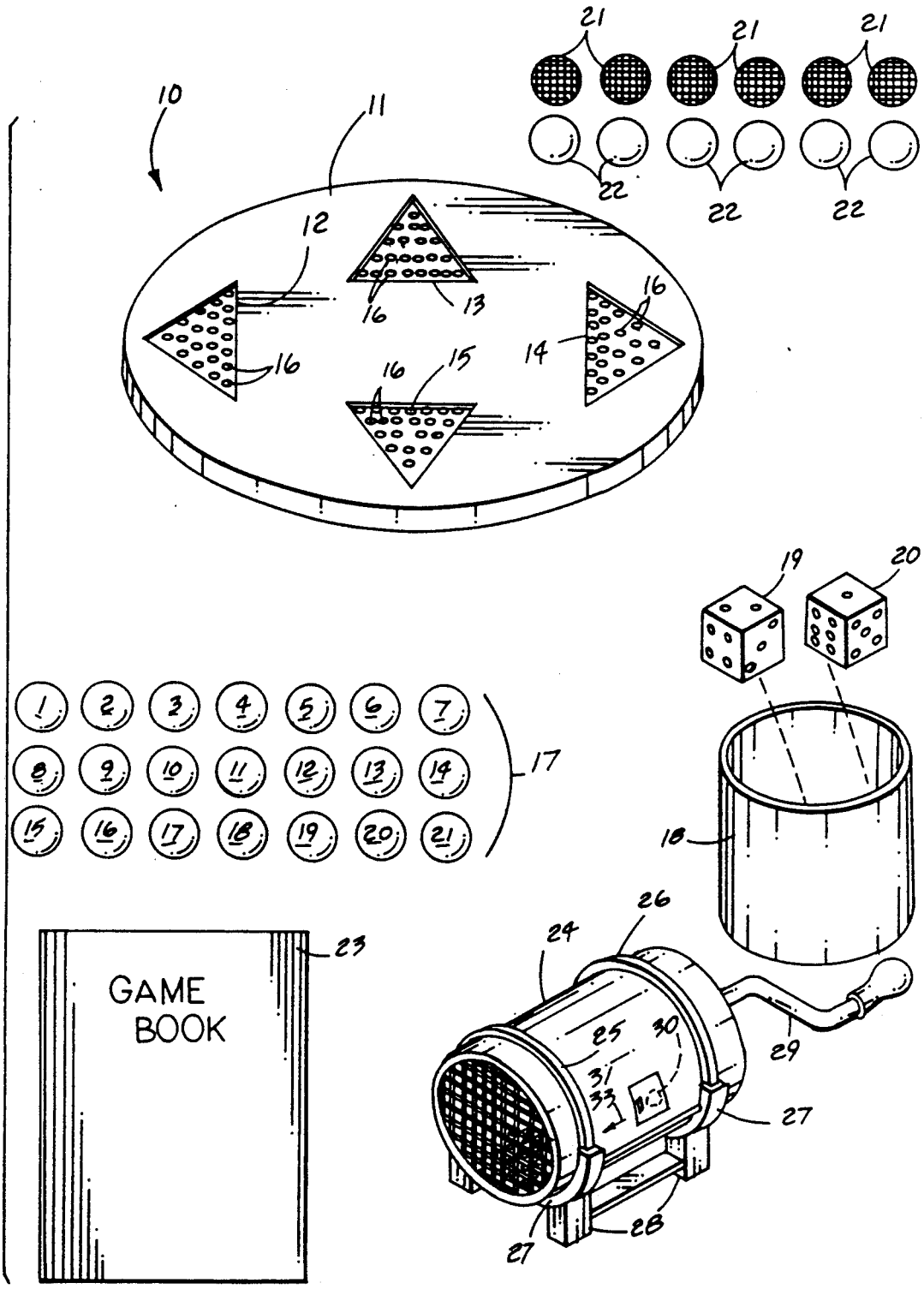
FIG. 3 is an isometric illustration of the various components of the instant invention.
Figure 4:
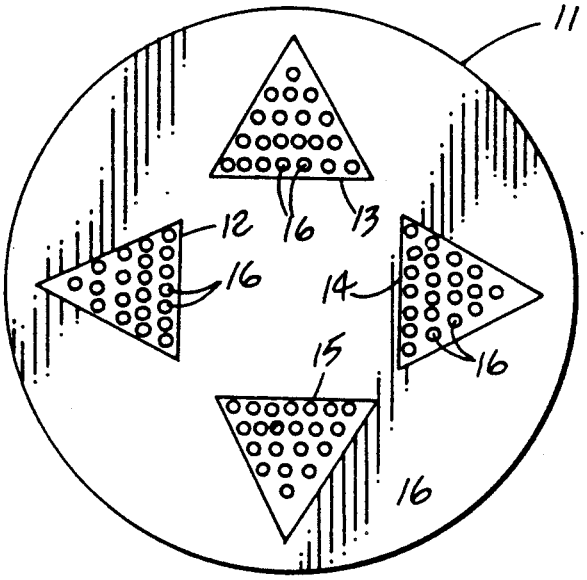
FIG. 4 is a top orthographic view of the game board of the instant invention.
Figure 5:
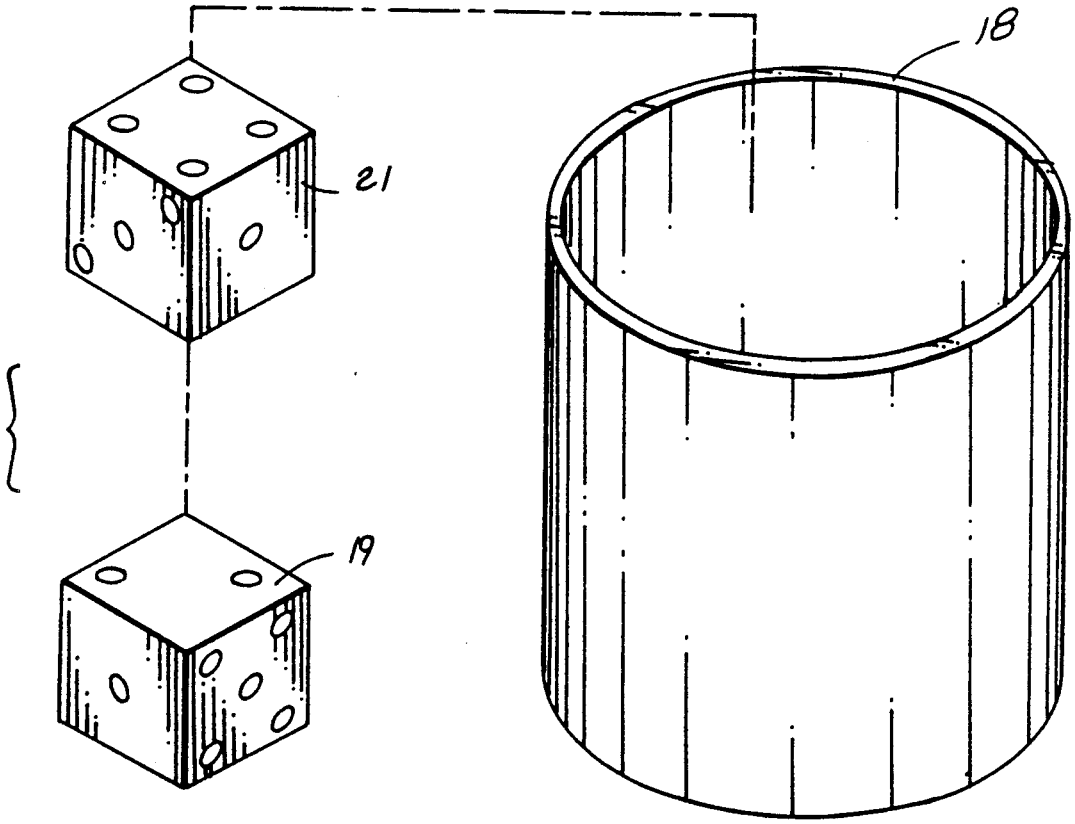
FIG. 5 is an isometric illustration of the dice and dice cup utilized by the instant invention.
Figure 6:
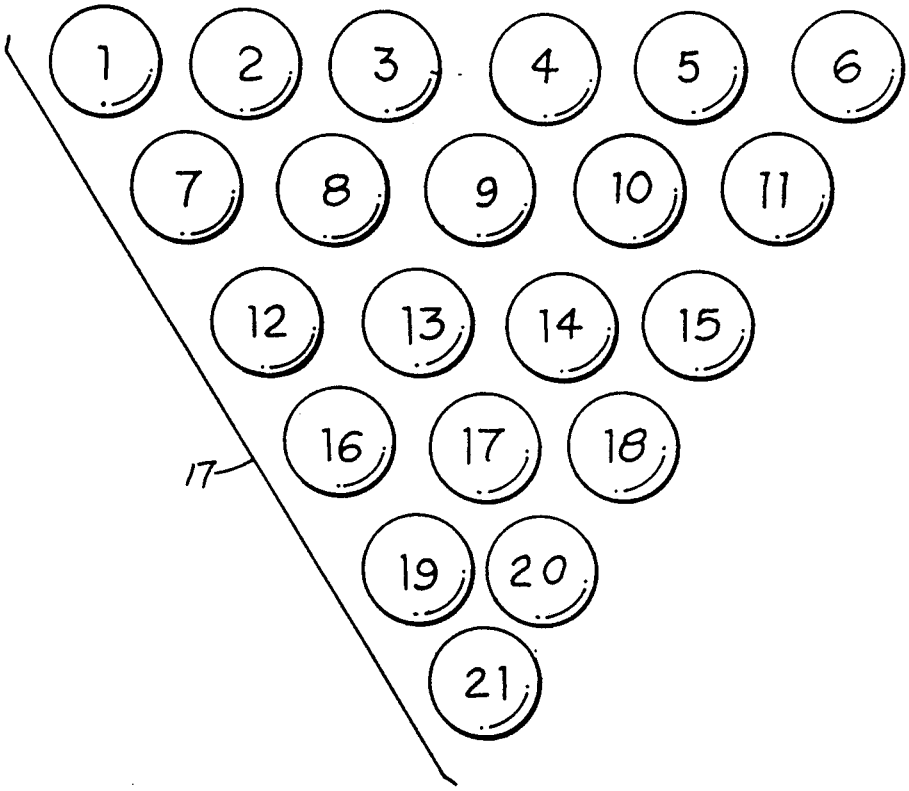
FIG. 6 is a top orthographic view of one of four sets of game spheres utilized by the instant invention.
Figure 7:
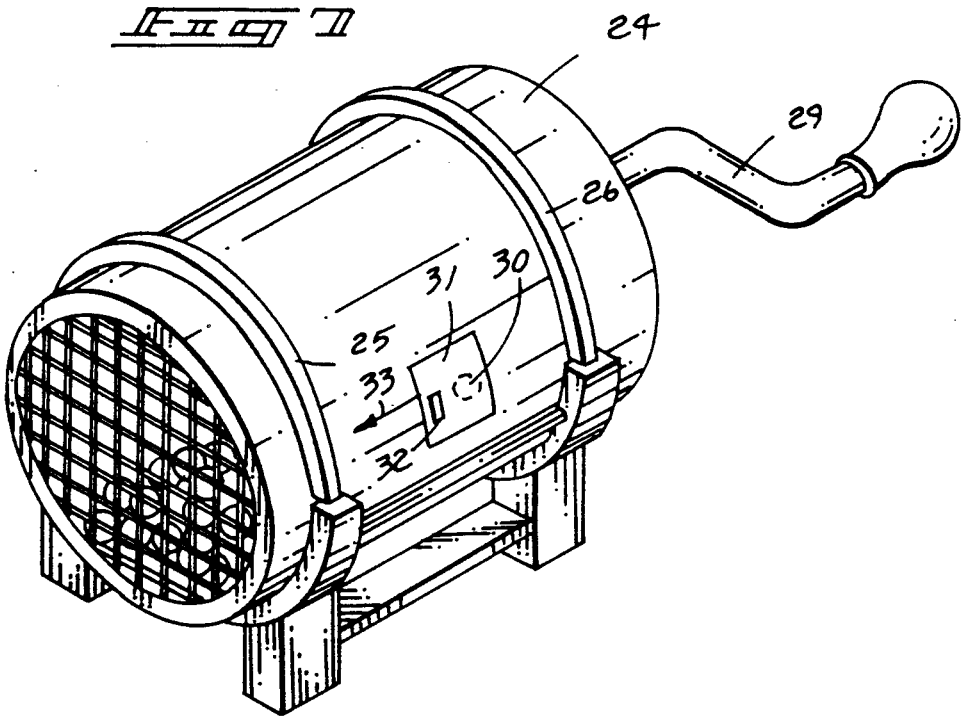
FIG. 7 is an isometric illustration of the tumbler utilized by the instant invention.

FIG. 1 illustrates a prior art bingo game apparatus of a type as set forth in U.S. Pat. No. 3,857,569 wherein the tray 2 includes a series of randomly positioned chips 3 that are randomly selected for association with the board portions 4 associated with each individual player. FIG. 2 illustrates a bingo game board 5 wherein recesses within the board 6 receives numbered squares, wherein individual numbers 7 utilize a napped surface to permit individuals of diminished vision to play the game.

More specifically, the bingo game apparatus 10 of the instant invention essentially comprises a rigid game board 11 conveniently of a generally circular configuration, including a top planar surface, wherein a first, second, third, and fourth recessed triangulated player position is recessed from the top player surface, wherein each player position includes twenty-one sequentially numbered semi-spherical recesses 16. Further, four sets of sequentially numbered playing spheres 17 are provided, wherein each of the four sets of playing spheres are of a differing or contrasting coloration to distinguish and associate each of the respective first through fourth player positions 12–15. A dice cup 18 is provided and is preferably of a felt lined interior surface to minimize unnecessary noise in its use, wherein a first and second dice member 19 and 20 of a six-sided configuration are provided. Further, six black spheres 21 and six white spheres 22 are also set forth, as well as the use of a rule book 23 provided for each individual player. A cylindrical drum 24 is rotatably mounted within a support, including support legs 28, wherein the cylindrical drum 24 is preferably also of a felt lined construction minimizing undo noise and impact of the various spheres positioned therewithin. Initially, each of the four sets of spheres 17, as well as the six black spheres 21 and the six white spheres 22, are positioned within the cylindrical drum 24. The drum 24 includes a first cylindrical ring 25 and a second cylindrical ring 26 spaced apart at a predetermined spacing relative to one another mounted integrally to an interior surface of the cylindrical drum 24. Each cylindrical ring is slidably received within a semicircular grooved support ring 27. The support rings 27 are also spaced apart the predetermined spacing to receive the cylindrical rings 25 and 26 therewithin. A crank handle 29 integrally mounted to the cylindrical drum rearwardly thereof permits manual rotation of the drum and the spheres positioned therewithin.

A circular opening 30 is directed through-extending the cylindrical drum 24 positioned medially between the first and second cylindrical rings 25 and 26, wherein the cylindrical opening 30 is defined by a diameter less than twice a predetermined diameter defined by each of the spheres 17, 21, and 22, but greater than the predetermined diameter of the spheres. The circular opening 30 is initially covered by a sliding door 31 including a door handle 32 mounted integrally thereto to permit retraction of the sliding door 31 in the direction of the directional arrow 33 to uncover the circular opening 30. In use, the circular drum is rotated, whereupon the circular opening 30 is positioned in a lowermost orientation to permit a single sphere to be received therethrough. The single sphere thus directed is of the category including the four sets of numbered spheres 17, as well as the six black and six white spheres 21 and 22 respectively.

When a single sphere is deposited from the drum 24, a player associated with that coloration may deposit that sphere upon an appropriately marked and numerated recess 16. A first player to reach a sequential predetermined array of spheres is declared a winner. In use, the two dice 19 and 20 are utilized prior to initiating the game to determine who goes first by a starting player achieving a greatest point total by the two dice 19 and 20. A starting player must then roll a seven or eleven to permit spinning of the drum 24 and permitting a single sphere to exit the drum 24. A rolling of a three by a player initiating play provides that player a free turn, wherein a rolling of a six ends that player's turn. In turn, each player is then attemping to obtain a sphere of their own coloration or a black sphere 21 which is set forth as a "wild" sphere which may be utilized in any numeration of sphere within the recesses 16 or be utilized by any of the first through fourth player positions 12–15 as a "wild" coloration. Further, the receiving of a white sphere 22 also provides that player a free turn to be utilized, such as upon a player rolling a six by the dice and thereby permits that player to continue.

As to the manner of usage and operation of the instant invention, the same should be apparent from the above disclosure, and accordingly, no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bingo game apparatus comprising, in combination, a rigid game board, the game board including a top planar surface including a series of equally spaced recessed player positions, the player positions each including a predetermined number of semi-spherical recesses therewithin, wherein each player position includes an equal predetermined number of semi-spherical recesses, and each of the spherical recesses of each of the player positions sequentially numbered, and plural sets of sequentially numbered playing spheres, and dispensing means for receiving the spheres and for dispensing individual spheres from the dispensing means, wherein each of the playing spheres are sequentially numbered to correspond to the sequentially numbered semi-spherical recesses of each player position, and including four sets of contrastingly colored playing spheres, each of a predetermined diameter, each set of playing spheres defined by a predetermined number of playing spheres equal to a predetermined number of semi-spherical recesses within each player position, and further including predetermined number of black spheres, and a further predetermined number of white spheres, wherein the black spheres are utilized as a "wild" sphere to be positioned within any one of the semi-spherical recesses within each of the player positions, and the white spheres providing each player with a free turn, and wherein the dispensing means includes a rotatable drum, the rotatable drum including a crank handle directed rearwardly thereof for rotation of the drum, and the rotating drum further including a plurality of cylindrical rings fixedly mounted at a predetermined spacing to an exterior surface of the cylindrical drum, and a plurality of semi-circular grooved support rings spaced apart the predetermined spacing, each receiving a cylindrical ring therewithin to permit support of the drum and relative rotation of the drum relative to the rings, and support legs mounted to the rings for support of the rings and the drum in use.

2. An apparatus as set forth in claim 1 wherein the drum further includes a circular opening directed through a side surface of the drum, and the circular opening defined by a circular opening diameter, and each of the playing spheres defined by a predetermined diameter, wherein the circular opening diameter is less than twice the predetermined diameter and greater than the predetermined diameter to permit directing of a single sphere therethrough.

3. An apparatus as set forth in claim 2 including a sliding door slidably mounted over the circular opening to permit selective exposure of the circular opening permitting selective deposit of a single sphere therethrough.

4. An apparatus as set forth in claim 3 further including a dice cup and a plurality of dice receivable therewithin, wherein the dice cup provides directional instruction to be utilized by each player sequentially for directing each player in dispensing of playing spheres through the circular opening of the drum.

* * * * *

UNITED STATES PATENT AND TRADEMARK OFFICE

CERTIFICATE OF CORRECTION

PATENT NO. : 4,999,001

DATED : Mar. 12, 1991

INVENTOR(S) : Robert G. Johnson, Sr.

It is certified that error appears in the above-identified patent and that said Letters Patent is hereby corrected as shown below:

On the title page, under item [19] and in item [76], "Johnson, Jr." should be --Johnson, Sr.--

Signed and Sealed this

Twenty-first Day of January, 1992

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,999,001

DATED : March 12, 1991

INVENTOR(S) : Robert G. Johnson, Sr.

It is certified that error appears in the above-identified patent and that said Letters Patent is hereby corrected as shown below:

On the title page, under item (19) and item (76), "Johnson, Jr." should be --Johnson, Sr.--.

Signed and Sealed this

Tenth Day of November, 1992

*Attest:*

DOUGLAS B. COMER

*Attesting Officer*

*Acting Commissioner of Patents and Trademarks*